US005139395A

United States Patent [19]

Kemmner

[11] Patent Number: 5,139,395

[45] Date of Patent: Aug. 18, 1992

[54] AGGREGATE FOR SUPPLYING FUEL FROM A SUPPLY TANK TO INTERNAL COMBUSTION ENGINE OF POWER VEHICLE

[75] Inventor: Ulrich Kemmner, Stuttgart, Fed. Rep. of Germany

[73] Assignee: Robert Bosch GmbH, Stuttgart, Fed. Rep. of Germany

[21] Appl. No.: 690,701

[22] Filed: Apr. 24, 1991

[30] Foreign Application Priority Data

Aug. 3, 1990 [DE] Fed. Rep. of Germany ..... 4024628

[51] Int. Cl.[5] ..... F04B 17/00; F04C 2/10

[52] U.S. Cl. ..... 417/366; 418/171

[58] Field of Search ..... 417/366, 410; 418/171

[56] References Cited

U.S. PATENT DOCUMENTS

| | | | |
|---|---|---|---|
| 1,648,730 | 11/1927 | Hill | 418/171 |
| 4,629,399 | 12/1986 | Friebe | 417/201 |
| 4,747,744 | 5/1988 | Dominique | 418/171 |
| 5,090,883 | 2/1992 | Krauter et al. | 418/171 |

*Primary Examiner*—Leonard E. Smith

*Assistant Examiner*—Roland McAndrews

*Attorney, Agent, or Firm*—Michael J. Striker

[57] ABSTRACT

An aggregate for supplying fuel from a supply tank to an internal combustion engine of a power vehicle has a housing with a cover, an electrical drive motor with a motor armature, a supply pump driven by the electric drive motor and formed as a gear pump. The supply pump has a toothed pinion and a toothed ring surrounding the toothed pinion and engaging with the latter. The toothed ring has a number of teeth which is greater than the number of teeth of the pinion and extends eccentrically to an axis of rotation of the motor armature while the pinion is arranged coaxially with the axis of rotation of the motor armature so that a local engagement between the teeth of the toothed ring and the pinion is obtained. A pump chamber is formed by the toothed ring and the pinion and also walls, The pinion is fixedly connected with the motor armature for joint rotation therewith, and one of the walls which is close to the motor armature is connected with a cover plate which is fixedly connected with the toothed ring for joint rotation therewith.

11 Claims, 1 Drawing Sheet

AGGREGATE FOR SUPPLYING FUEL FROM A SUPPLY TANK TO INTERNAL COMBUSTION ENGINE OF POWER VEHICLE

BACKGROUND OF THE INVENTION

The present invention relates to an aggregate for suppyling fuel from a supply tank to an internal combustion engine of a power vehicle.

Aggregates of such a general type are known in the art. One of such aggregates is disclosed, for example in the German document DE-OS 3,437,021. In this aggregate the pinion is connected with an armature shaft of an electrical drive motor for joint rotation therewith. The drive shaft of the drive motor extends through a plate which is fixedly connected with the aggregate housing, and a limiting wall is formed on the plate for limiting a pump chamber. A bearing pin for the toothed pinion extends from the other wall. Moreover, the toothed ring of the gear pump is guided in a ring which holds the both above mentioned walls at a predetermined distance from one another. In connection with this it is completely unimportant that in the known supply aggregate the toothed ring is formed as a supply member of a flow pump which operates as a pre-supply pump.

SUMMARY OF THE INVENTION

Accordingly, it is an object of the present invention to provide a supply aggregate of the above mentioned general type, which avoids the disadvantages of the prior art.

More particularly, it is an object of the present invention to provide a supply aggregate of the above mentioned type in which a guiding ring of the toothed ring which serves as a spacer can be dispensed with.

In keeping with these objects and with others which will become apparent hereinafter, one feature of the present invention resides, briefly stated, in an aggregate for supplying a fuel from a supply tank to an internal combustion engine of a power vehicle, in which the pinion is fixedly connected with the motor armature for joint rotation therewith and a wall which is located close to the motor armature is arranged on a cover plate which is fixedly connected with a toothed ring for joint rotation with the latter.

When the supply aggregate is designed in accordance with the present invention, it eliminates the disadvantages of the prior art and provides for the above-emphasized advantage. Moreover, the support of the toothed pinion is simplified since due to the direct connection of the pinion with the motor armature the lateral bearing support coaxial with the axis of rotation is no longer required.

In accordance with another feature of the present invention, the pinion is arranged on an extension of the armature shaft of the electric motor, and the extension extends through the pinion and is supported with its free end in the other wall.

Still another feature of the present invention is that the other wall is a part of a pump chamber of a pump pre-stage located before the gear pump.

The pinion can be connected fixedly with a sleeve for joint rotation therewith, and the sleeve can be fixedly connected with the armature shaft.

A further feature of the present invention is that the sleeve extends through an opening in the cover plate from the pinion to the motor armature. The center of the opening can be coaxial to the axis of rotation of the toothed ring and its diameter corresponds to a sum of the value of the diameter of the sleeve and the value of the eccentricity between the pinion and the toothed ring.

The sleeve can end inside the pinion, and a ring-shaped disc can be arranged between the end surface of the sleeve and the associated wall. The disc can be provided with at least one axially extending driver which engages in a matching opening extending radially from the sleeve to the hub of the pinion.

The diameter of the disc can be seleced greater than the diameter of the sleeve, and the driver can extend from the opening of the disc to the outer edge of the disc.

The cover plate can be connected with the toothed ring fixedly, for example by welding.

Finally, the wall which is remote from the motor armature can be arranged on a housing cover of the housing of the aggregate. It can be provided both with a suction opening which opens toward the fuel tank and also with a supply passage which communicates the pump chamber with the pressure chamber of the supply aggregate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
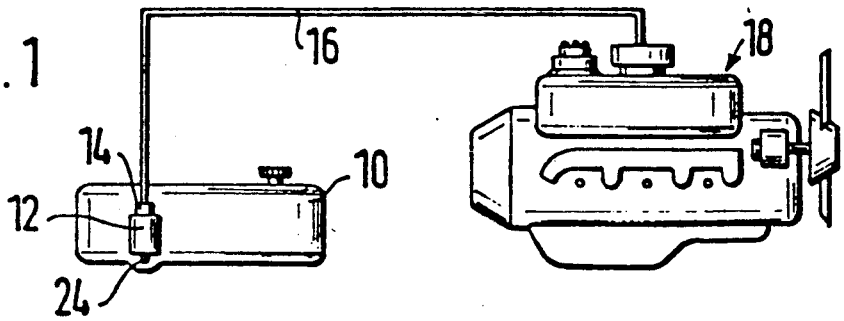
FIG. 1 is a schematic view showing a supply arrangement with a fuel supply tank and an internal combustion engine.

FIG. 1 shows a fuel tank 10 in which a fuel supply aggregate 12 is arranged. A pump conduit 16 is connected with a pump pipe 14 of the fuel supply conduit 12. The pressure conduit 16 leads to an internal combustion engine 18. During the operation of the internal combustion engine the fuel supply aggregate 12 supplies fuel from the supply tank 10 to the internal combustion engine 18.

Figure 2:
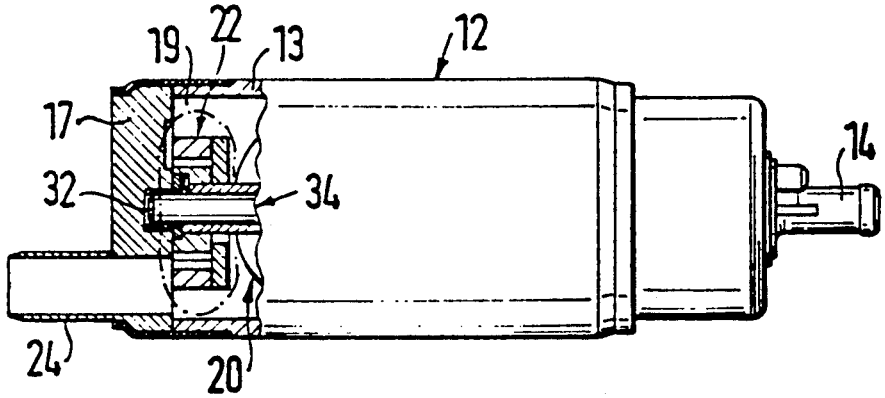
FIG. 2 is a view showing a supply aggregate of the supply arrangement, on an enlarged scale and partially sectioned.

As can be seen from FIG. 2, the fuel supply aggregate 12 has a tubular housing part 13. Both tubular openings of the housing part 13 are closed by covers 17. Only one of the covers is shown in FIG. 2. The housing 13 together with the cover 17 form an enclosed chamber 19. An electric drive motor 20 and a supply pump 22 are accommodated in the chamber 19. The cover 17 has an aspiration pipe 24 which opens in the supply tank 10. The fuel supply aggregate 12 in accordance with the shown embodiment has only one pump stage which illustrates the present invention. It is of course possible to arrange further pump stages before or after of the shown one stage, without deviating from the spirit of the present invention. It is however advantageous when the pump stage is located before further stages since it is possible in accordance with the present invention in a simple manner.

The fuel supply pump 22 of the supply aggregate 12 is a so-called inner toothed wheel pump. It has a toothed pinion 26 which is supported with its central opening 28 on a bearing bush 30. The bearing bush 30 is arranged on an extension 32 of an armature shaft 34 of the motor armature so as to rotate together with the same. The toothing 33 of the pinion 26 engages with a countertoothing 35 of the toothed ring 36. The countertoothing 35 is arranged on the inner surface of the toothed ring 36 as shown in FIG. 4. As can be seen from FIGS. 3 and 4, the pinion 26 is arranged concentrically to the axis of rotation of the armature shaft 34 or the axis of rotation of its extension 32. The engagement of the toothing 32 and 35 is obtained in that the toothed ring 36 is eccentrically mounted relative to the pinion 26. This eccentricity is identified in FIG. 4 with reference numeral 38. As shown in FIG. 4, the substantially sickle-shaped pump chamber 40 is provided between both toothings 33 and 35.

Figure 3:
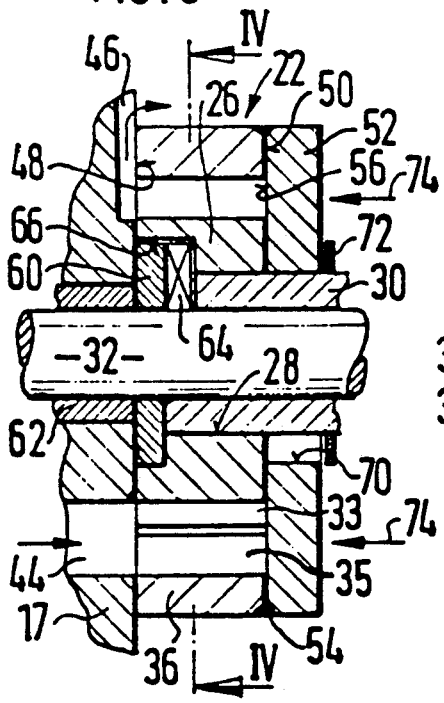
FIG. 3 is a view showing a fragment of a supply pump of FIG. 2 identified with reference numeral III, on an enlarged scale.
Figure 4:
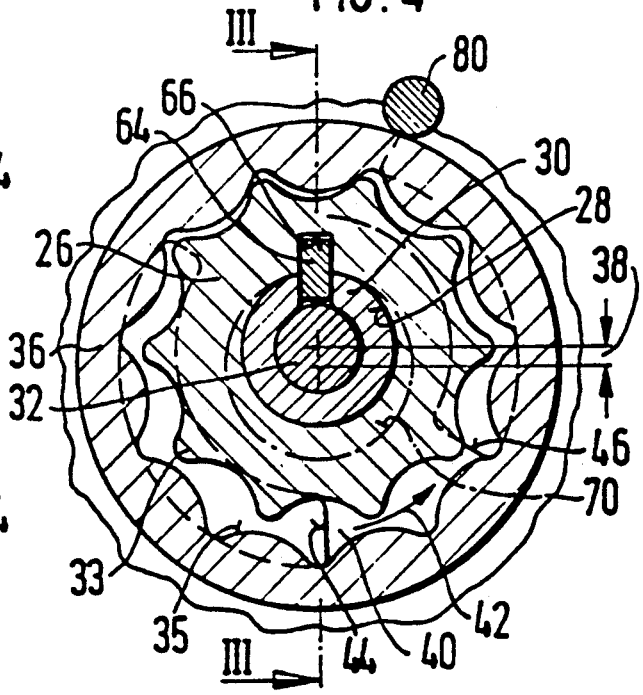
FIG. 4 is a view showing a section taken along the line III—III through the supply pump of FIG. 3.

With consideration cf the rotary direction which is identified in FIG. 4 with the arrow 42, the housing cover 17 has a kidney-shaped aspiration opening 44 which is shown in section in FIG. 3. Behind the aspiration opening 44 as considered in the direction of rotation, a pumping or supply passage 46 is provided in the housing cover 17. The supply passage 46 communicates a pressure region of the pump 22 which is located at the rear in the rotary direction in accordance with the arrow 42, with the chamber 19 of the supply aggregate 12 formed by the housing 13 and the covers 17. During the operation of the supply aggregate a supply pressure acts in the chamber 19.

Each cover 17 has ar inner wall 48. Both the pinion 26 and the toothed ring 36 abut with their one end surface against the inner wall 48. A ring-shaped cover plate 52 shown in FIG. 3 is mounted on the other end surface 50 of the toothed ring 36 and connected for joint rotation with the toothed ring 36, for example by welding. Such a welding seam is shown in FIG. 3 and identified with reference numeral 54. The cover plate 52 is provided with a wall 56 which faces the end surface 50 of the toothed ring 36. The other end surface of the toothed pinion 26 abuts against the wall 56. Both walls 48 and 56 of the housing cover 17 or the cover plate 52 limit therefore a pump chamber 40 in direction of the axis of rotation of the armature shaft 34, 32.

The fixed connection between the sleeve 30 and the pinion 26 for their joint rotation is obtained in the shown embodiment in that the sleeve ends inside the pinion 26. Thereby a chamber is produced for arranging a ring-shaped disc 60 between the sleeve 30 and the cover 17. The extension 32 of the armature shaft 34 extends through the pinion 26 and the opening of disc 60 and is guided in a bearing bush 62 arranged in the cover 17. The disc 60 is integral with a driver 64 which extends toward the sleeve 30 and is inserted in a matching recess 66 of the sleeve. The recess 66 extends from the sleeve 30 to the inner region of the pinion 26 which can also be identified as a hub. The arrangement of several drivers integral with the disc 60 is also recommended. A corresponding recess is associated with each driver. FIG. 4 shows how the extension of the driver from the sleeve 30 into the pinion 26 is designed. FIG. 3 further shows that the diameter of the disc 60 is greater than the diameter of the sleeve 30 and the driver 64 extends from the opening of the disc 60 to the radial outer edge.

FIGS. 3 and 4 also show that the sleeve 30 extends through an opening 70 of the cover plate 52, and the center of the opening 70 is coaxial with the axis of rotation of the toothed ring 36. The diameter of the opening 70 corresponds to the diameter of the sleeve 30 plus the magnitude of the eccentricity 38 between the pinion 26 and the toothed ring 36. This can be recognized from FIG. 4 with regard to the opening 70 as defined in dash-dot line. The opening 70 is identified in dash-dot lines since due to the position of the section IV—IV it cannot be seen in this Figure, and the showing is provided for understanding of the invention.

Furthermore, a safety shoulder 72 is provided on the sleeve 30. It prevents an excessive axial displacement of the toothed ring 36 together with the cover plate 52. During the operation of the supply aggregate the toothed pump 22 aspirates the fuel through the suction opening 44 from the supply tank 10 and pumps it through the pumping kidney 46 or the pump channel 46 into the chamber 19. There a pressure is built up with the small axial play of the structural elements 36, 52. This pressure is sufficient to press the structural elements 36, 52 in direction of the arrow 74 and together with the pinion 26 to abut against the wall 48 of the housing cover. Therefore, a further pressure increase in the pressure 19 occurs, while the fuel flows through the chamber 19 til it discharges from the pump pipe 14 and is supplied through the conduit 16 to the internal combustion engine.

In addition to the above described advantages, the new inner toothed gear pump provides for further advantages:

The production of the height of both toothed wheels 26, 36 which engage one another can be performed in the same working step. It is however critical that the height of the both wheels is identical. An absolute value is not required. Due to the subsequent connection of the toothed ring 36 and the cover plate 52 the individual parts can be produced in a simple manner. This is true for the arrangement of the opening 70 which is located concentrically to the toothing of the toothed ring 36. In the opening 70 a linear contact with the surface of the sleeve 30 is obtained. This line travels during the operation of the inner toothed gear pump 22 about the axis of rotation of the armature shaft 34. As a further advantage, the pinion 26 is arranged without an axial plate in the walls 48, 56. Thereby an outstanding hydraulic efficiency is achieved. Due to the saving of guiding ring which serves as a spacer between the walls, the pump chamber and thereby the supply capacity can be markedly increased without increasing the space consumption for the supply pump. When needed, a support element 80 can be arranged on the outer contour of the toothed ring, for example by pressing in the cover 17, for preventing excessive deviations of the toothed ring in the pressure-less operation of the toothed gear pump. Also, during the axial abutment of the motor armature against the cover 17 there is an advantage since the ring 60 is selected from a material which has high sliding properties with respect to the material of the cover 17.

It will be understood that each of the elements described above, or two or more together, may also find a useful application in other types of constructions differing from the types described above.

While the invention has been illustrated and described as embodied in an aggregate for supplying fuel from a supply tank to an internal combustion engine of a power vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for supplying fuel from a supply tank to an internal combustion engine of a power vehicle, comprising a housing with a cover; an electrical drive motor with a motor armature; a supply pump driven by said electric drive motor and forced as a gear pump, said supply pump having a toothed pinion and a toothed ring surrounding said toothed pinion and engaging with the latter, said toothed ring having a number of teeth which is greater than the number of teeth of said pinion and extends eccentrically to an axis of rotation of said motor armature, while said pinion is arranged coaxially with the axis of rotation of said motor armature so that a local engagement between the teeth of the toothed ring and the pinion is obtained; and means forming a pump chamber including said toothed ring and said pinion and also walls, said pinion being fixedly connected with said motor armature for joint rotation therewith, and one of said walls which is close to said motor armature is connected with a cover plate which is fixedly connected with said toothed ring for joint rotation therewith.

2. An aggregate as defined in claim 1; and further comprising means for fixedly connecting said cover plate with said toothed ring and including a welding seam.

3. An aggregate as defined in claim 1, wherein said supply pump has a further wall which is remote from said motor armature and arranged on said cover, said wall having an opening which is open toward a fuel tank and a supply passage communicating said pump chamber with a pressure chamber of the aggregate.

4. An aggregate as defined in claim 1, wherein said armature has an armature shaft with an extension having a free end, said extension of said armature shaft extending through said pinion and supporting the same, said free end of said extension of said armature shaft is supported in another of said walls.

5. An aggregate as defined in claim 4, wherein said other wall limits said pump chamber.

6. An aggregate as defined in claim 5, wherein said pump chamber is a part of a pump pre-stage which is located before said pump.

7. An aggregate as defined in claim 4, wherein said pump further has a sleeve, said pinion being fixedly connected with said sleeve for joint rotation therewith, said sleeve being fixedly connected with said extension of said armature shaft for joint rotation therewith.

8. An aggregate as defined in claim 7, wherein said cover plate has an opening, said pinion extending through said opening of said cover plate outwardly to said motor armature.

9. An aggregate as defined in claim 8, wherein said opening in said cover plate has a center which is coaxial with an axis of rotation of said toothed ring and also has a diameter which is greater than a sum of the value of the diameter of said sleeve and the value of an eccentricity between said pinion and said toothed ring.

10. An aggregate as defined in claim 7, wherein said sleeve extends inside said pinion and has an end surface which together with a wall forms a space, said supply pump further having a ring-shaped disc located in said space and provided with at least one axially projecting driver which extends in a matching opening extending radially from said sleeve to said pinion.

11. An aggregate as defined in claim 10, wherein said disc has a shaft opening, an outer radial edge and a diameter which is greater than a diameter of said sleeve, said driver extending radially from said shaft opening in said disc to an outer radial edge of said disc.

* * * * *